US005799343A

United States Patent [19]

Semco et al.

[11] Patent Number: 5,799,343

[45] Date of Patent: Sep. 1, 1998

[54] UNIVERSAL SKIMMER ICE PROTECTOR

[76] Inventors: Stanley A. Semco; Joseph J. Tedona, both of 8-22 Melvin Pl., Fair Lawn, N.J. 07410

[21] Appl. No.: 329,286

[22] Filed: Oct. 26, 1994

[51] Int. Cl.[6] ..... E04H 4/06

[52] U.S. Cl. ..... 4/504; 4/295

[58] Field of Search ..... 4/225.08, 295, 4/496, 504, 512

[56] References Cited

U.S. PATENT DOCUMENTS 0,117,402 7/1871 Gibson et al. ..... 4/295
2,245,887 6/1941 Wikander ..... 4/295
3,552,567 1/1971 Arp ..... 4/512 X
3,596,295 8/1971 Wilson ..... 4/504 X

*Primary Examiner*—Robert M. Fetsuga

[57] ABSTRACT

An ice protector for absorbing the expansion of ice within a pool skimmer during freezing conditions. The inventive device includes a hollow compressible container having a stopper engagable to the fluid conduit within the skimmer. The stopper is operable to plug the conduit and support the container in a vertical orientation projecting above the waterline such that freezing of the water will compress the container to preclude damage to the skimmer. The device may further include a plurality of extension caps attachable to the container to accommodate various skimmer sizes and to ensure projection of the container above a high waterline.

2 Claims, 5 Drawing Sheets

UNIVERSAL SKIMMER ICE PROTECTOR

BACKGROUND OF THE INVENTION

1. Field of the Invention

The present invention relates to swimming pool structures and more particularly pertains to an ice protector for absorbing the expansion of ice within a pool skimmer during freezing conditions.

2. Description of the Prior Art

The use of swimming pool structures is known in the prior art. More specifically, swimming pool structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art swimming pool structures include U.S. Pat. No. 5,225,075; U.S. Pat. No. 5,060,321; U.S. Pat. No. 5,038,949; U.S. Pat. No. 3,596,295; and U.S. Pat. No. 3,552,567.

While these devices fulfill their respective, particular objectives and requirements, the aforementioned patents do not disclose an ice protector of absorbing the expansion of ice within a pool skimmer during freezing conditions which includes a hollow compressible container having a stopper engagable to the fluid conduit within the skimmer so as to support the container in a vertical orientation projecting above the waterline to preclude freezing damage to the skimmer. Furthermore, none of the known prior art pool structures teach or suggest a universal skimmer ice protector of the aforementioned structure which further includes a plurality of extension caps attachable to the container to accommodate various skimmer sizes and to ensure projection of the container above a high waterline.

In these respects, the universal skimmer ice protector according to the present invention substantially departs from the conventional concepts and designs of the prior art, and in so doing provides an apparatus primarily developed for the purpose of absorbing the expansion of ice within a pool skimmer.

SUMMARY OF THE INVENTION

In view of the foregoing disadvantages inherent in the known types of swimming pool structures now present in the prior art, the present invention provides a new universal skimmer ice protector construction wherein the same can be utilized for protecting a pool skimmer during freezing conditions. As such, the general purpose of the present invention, which will be described subsequently in greater detail, is to provide a new universal skimmer ice protector apparatus and method which has many of the advantages of the swimming pool structures mentioned heretofore and many novel features that result in a universal skimmer ice protector which is not anticipated, rendered obvious, suggested, or even implied by any of the prior art swimming pool structures, either alone or in any combination thereof.

To attain this, the present invention generally comprises an ice protector for absorbing the expansion of ice within a pool skimmer during freezing conditions. The inventive device includes a hollow compressible container having a stopper engagable to the fluid conduit within the skimmer. The stopper is operable to plug the conduit and support the container in a vertical orientation projecting above the waterline such that freezing of the water will compress the container to preclude damage to the skimmer. The device may further include a plurality of extension caps attachable to the container to accommodate various skimmer sizes and to ensure projection of the container above a high waterline.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new universal skimmer ice protector apparatus and method which has many of the advantages of the swimming pool structures mentioned heretofore and many novel features that result in a universal skimmer ice protector which is not anticipated, rendered obvious, suggested, or even implied by any of the prior art swimming pool structures, either alone or in any combination thereof.

It is another object of the present invention to provide a new universal skimmer ice protector which may be easily and efficiently manufactured and marketed.

It is a further object of the present invention to provide a new universal skimmer ice protector which is of a durable and reliable construction.

An even further object of the present invention is to provide a new universal skimmer ice protector which is susceptible of a low cost of manufacture with regard to both materials and labor, and which accordingly is then susceptible of low prices of sale to the consuming public, thereby making such universal skimmer ice protectors economically available to the buying public.

Still yet another object of the present invention is to provide a new universal skimmer ice protector which provides in the apparatuses and methods of the prior art some of the advantages thereof, while simultaneously overcoming some of the disadvantages normally associated therewith.

Still another object of the present invention is to provide a new universal skimmer ice protector for absorbing the expansion of ice within a pool skimmer during freezing conditions to protect the skimmer from damage.

Yet another object of the present invention is to provide a new universal skimmer ice protector which includes a hollow compressible container having a stopper engagable to the fluid conduit within the skimmer so as to support the container in a vertical orientation projecting above the waterline to preclude damage to the skimmer.

Even still another object of the present invention is to provide a new universal skimmer ice protector which further includes a plurality of extension caps attachable to the container to accommodate various skimmer sizes and to ensure projection of the container above a high waterline.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
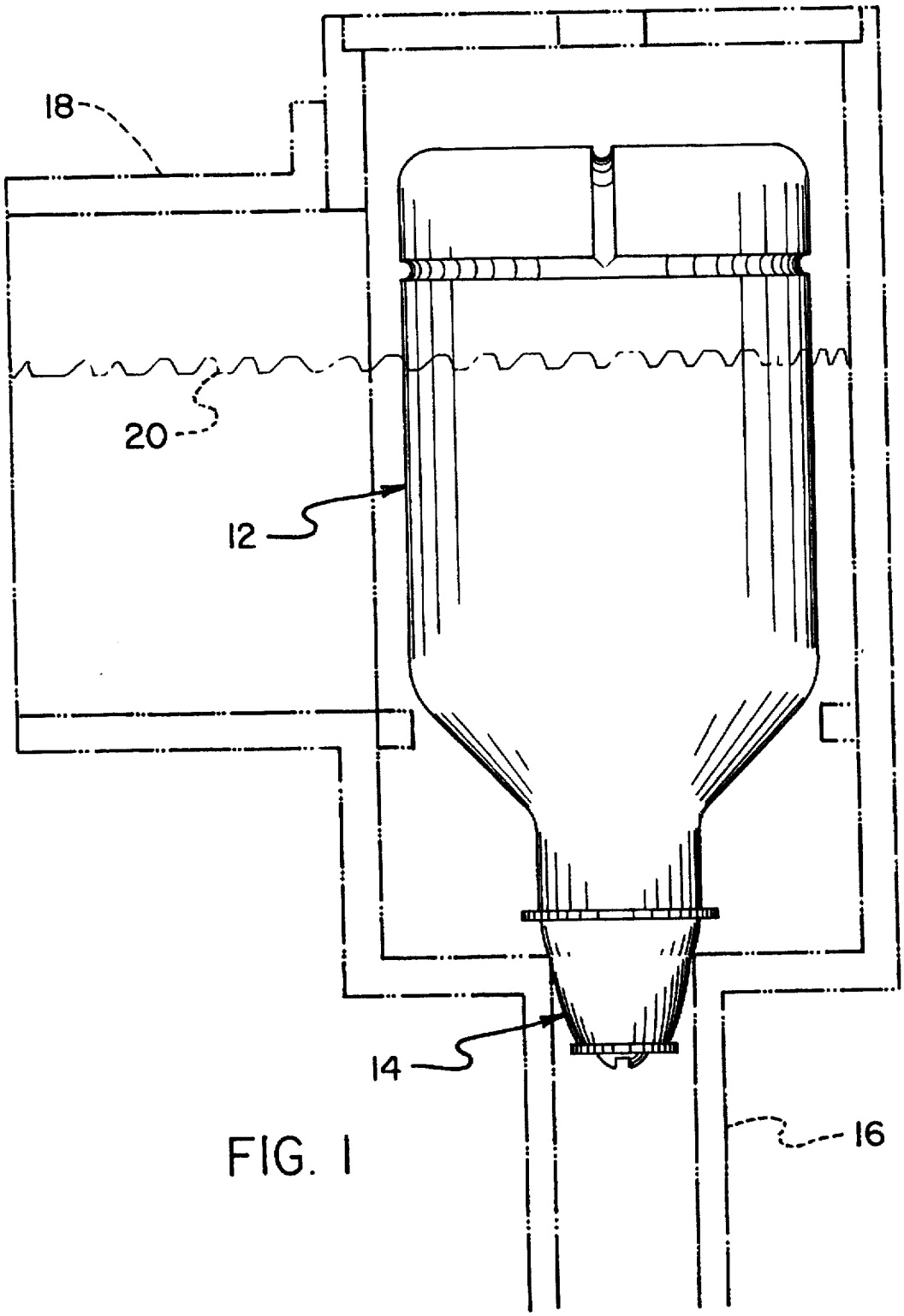
FIG. 1 is a side elevation view of a universal skimmer ice protector according to the present invention as installed within a pool skimmer.

With reference now to the drawings, and in particular to FIGS. 1–7 thereof, a new universal skimmer ice protector embodying the principles and concepts of the present invention and generally designated by the reference numeral 10 will be described.

Figure 2:
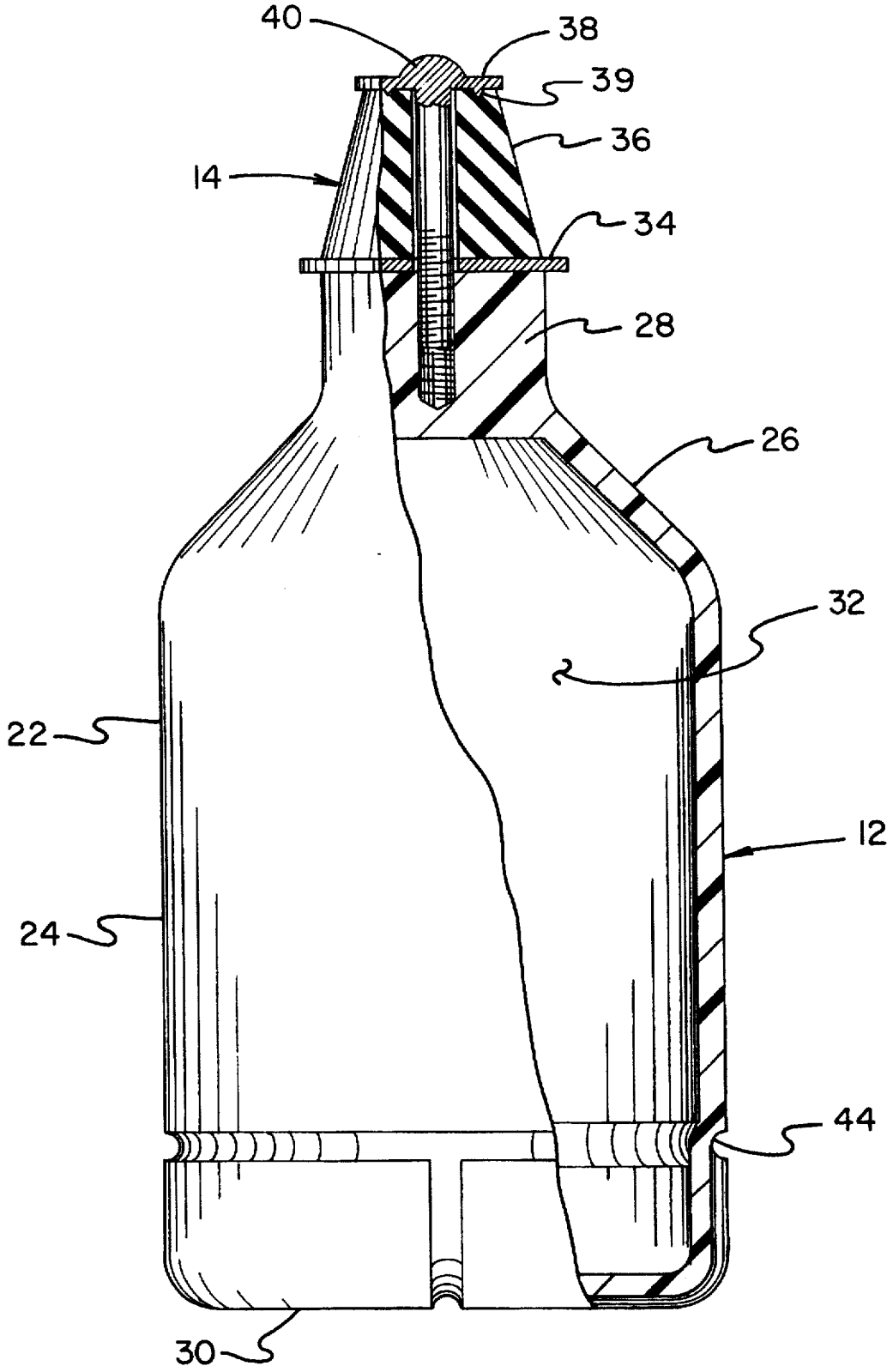
FIG. 2 is a front elevation view of the present invention, partially in cross section.

More specifically, it will be noted that the universal skimmer ice protector 10 comprises an expansion compensator means 12 having a plug means 14 secured thereto for engaging and sealing a fluid conduit 16 of a conventionally known pool skimmer 18. The expansion compensator means 12 is operable to project above a waterline 20 such that freezing of water within the skimmer 18 will compress the expansion compensator means 12 to preclude expansion and subsequent fracturing of the pool skimmer 18 during freezing conditions. As best illustrated in FIG. 2, the expansion compensator means 12 comprises a hollow container 22 having a compressible cylindrical side wall 24 extending in a first direction to define a tapered neck 26 terminating in a mounting boss 28 of sealed, solid construction. The compressible cylindrical side wall 24 extends in a second direction and terminates in a closed upper end 30 to complete the hollow container 22. Preferably, the hollow container 22 of the expansion compensator means 12 comprises a sealed interior space 32 filled with air or any other gas at ambient pressure. However, it is within the intent and purview of the present invention 10 to include vent apertures extending through the closed upper end 30 which permit venting of the air from within the interior space 32 during compression of the cylindrical side wall 24.

Figure 3:
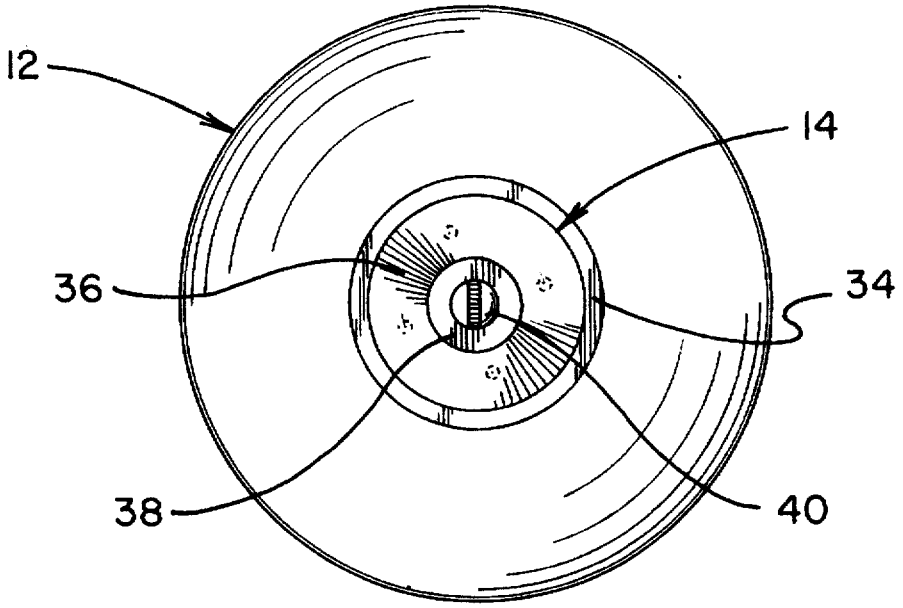
FIG. 3 is a bottom plan view of the device.

As shown in FIG. 1, the plug means 14 is operable both to seal the fluid conduit 16 and to support the hollow container 22 in a substantially vertical orientation so as to project above the waterline 20. To this end, the plug means 14 comprises a first washer 34 having a center aperture positioned in abutting relation relative to the mounting boss 28, as shown in FIG. 2. A resilient stopper 36, also having a center aperture, is positioned against the first washer 34, with a second washer 38 being positioned against an outer distal end of the resilient stopper 36 and having a plurality of engaging prongs 39 which extend into the resilient stopper to preclude rotation of the second washer relative to the stopper. A fastener 40 is integrally coupled to the second washer 38, and extends through the center apertures in the resilient stopper 36 and the first washer 34 to threadably engage the mounting boss 28 and secure the plug means 14 to the hollow container 22. As shown in FIG. 2 and 3, The resilient stopper 36 is preferably tapered so as to accommodate a variety of fluid conduit sizes 16, thereby imparting a universal fitting of the device to a plurality of disparate pool skimmers 18. To this end, the first washer 34 is positioned against a first end of the resilient stopper 36, with the first end of the resilient stopper having a first diameter and tapering to a second end having a second diameter, wherein the first diameter of the resilient stopper is substantially greater than the second diameter at the second end. Accordingly, the first washer 34 is of a third diameter and the second washer 38 is of a fourth diameter, wherein the third diameter is substantially larger than the fourth diameter, as shown. By this structure, the resilient stopper 36 of the plug means 14 can be frictionally engaged to the fluid conduit 16, as shown in FIG. 1, to support the hollow container 22 in a vertical orientation and projecting above the waterline 20. Further, the fastener 40 can be selectively tightened through a rotation of the hollow container to effect longitudinal compression and radial expansion of the stopper 36 to impart adjustability to the device 10 so as to accommodate an increased number of disparate fluid conduits 16. In other words, the stopper 36 can be positioned within the fluid conduit 16, and the hollow container can then be rotated relative to the conduit 16 and the stopper frictionally engaged thereto to effect a longitudinal compression of the stopper creating a radial expansion which locks the stopper into place within the fluid conduit.

Figure 4:
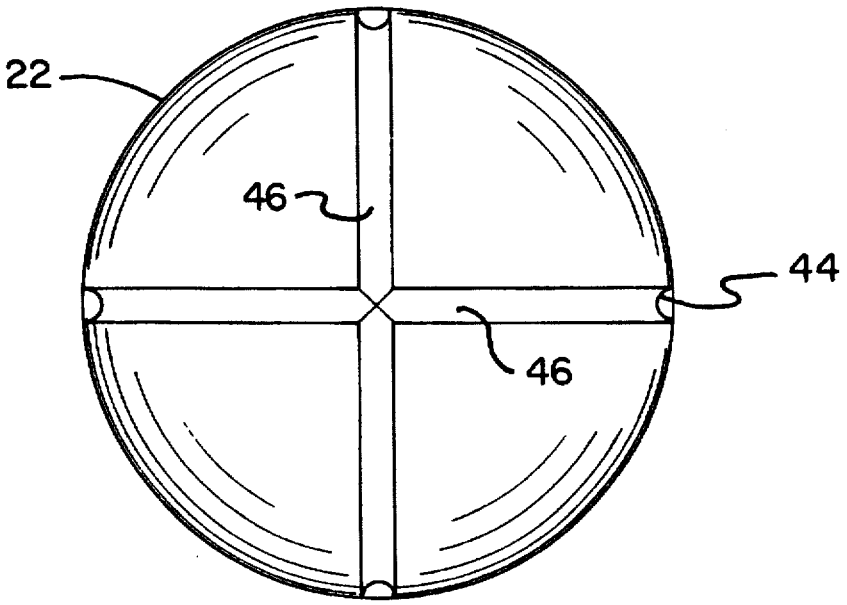
FIG. 4 is a top plan view of the ice protector.
Figure 5:
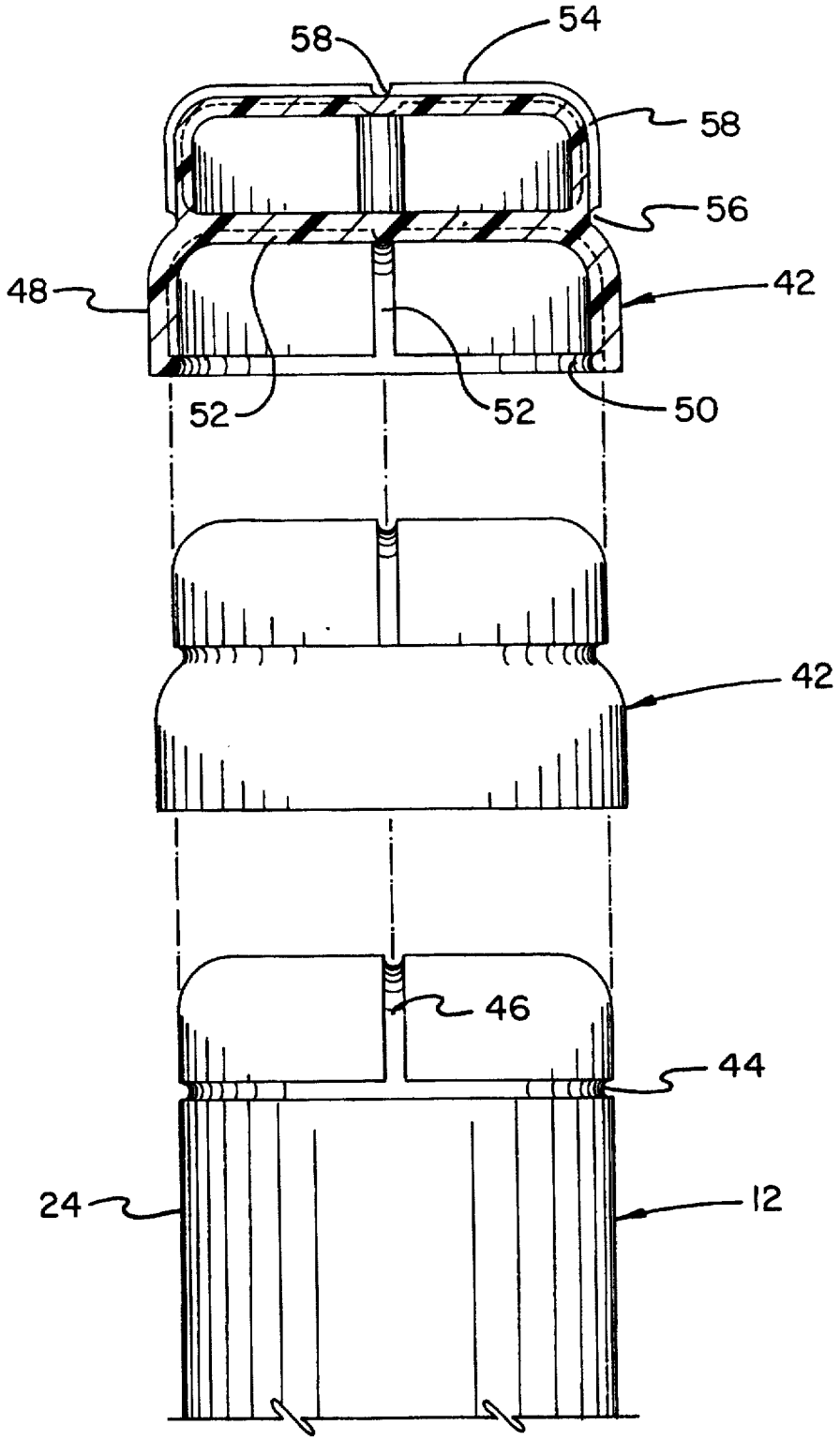
FIG. 5 is an exploded view, partially in cross section, illustrating the addition of at least one hollow extension cap to the present invention.

Because pool skimmers 18 are constructed in different sizes and water levels within such pool skimmers often vary, it is desirable to include a plurality of hollow extension caps 42 which may be selectively engaged to the closed upper end 30 of the hollow container 22. To this end, and as shown in FIGS. 4 and 5, the cylindrical side wall 24 of the hollow container 22 is preferably provided with a circumferential mounting groove 44 which extends about the cylindrical side wall. Further, A pair orthogonally oriented transverse mounting grooves 46 may additionally be provided to extend from diametrically opposed sides of the circumferential mounting groove 44 and over the closed upper end 30 of the hollow container 22, as best illustrated in FIG. 4.

Turning now to FIG. 5, it can be shown that the hollow extension caps 42 each include a receiver 48 positionable over the closed upper end 30 of the hollow container 22. A circumferential projection 50 extends about an interior surface of the receiver 48 and is correspondingly positioned so as to project into the circumferential mounting groove 44 of the cylindrical side wall 24. Further, orthogonally oriented transverse projections 52 extend from the circumferential projection 50 across the interior surface of the receiver 48 and are correspondingly positioned so as to engage the transverse mounting groove 46 of the cylindrical side wall 24 to preclude rotation and loosening of the extension cap 42 relative to the container 22. The extension caps 42 further comprise a compressible chamber 54 attached to the receiver 48, with the chamber having a correspondingly shaped circumferential mounting groove 56, as well as a pair of transverse mounting grooves 58 which permit a plurality of the hollow extension caps 42 to be coupled together in a manner similar to the coupling of a single hollow extension cap to the container 22 of the expansion compensator 12. By this structure, one or more hollow extension caps 42 can be secured to the closed upper end 30 of the hollow container 22 so as to project above the waterline 20 within the pool skimmer 18. The extension caps 42 permit the present invention 10 to be adapted to any of the numerous sizes of pool skimmers 18 conventionally available.

Figures 6, 7:
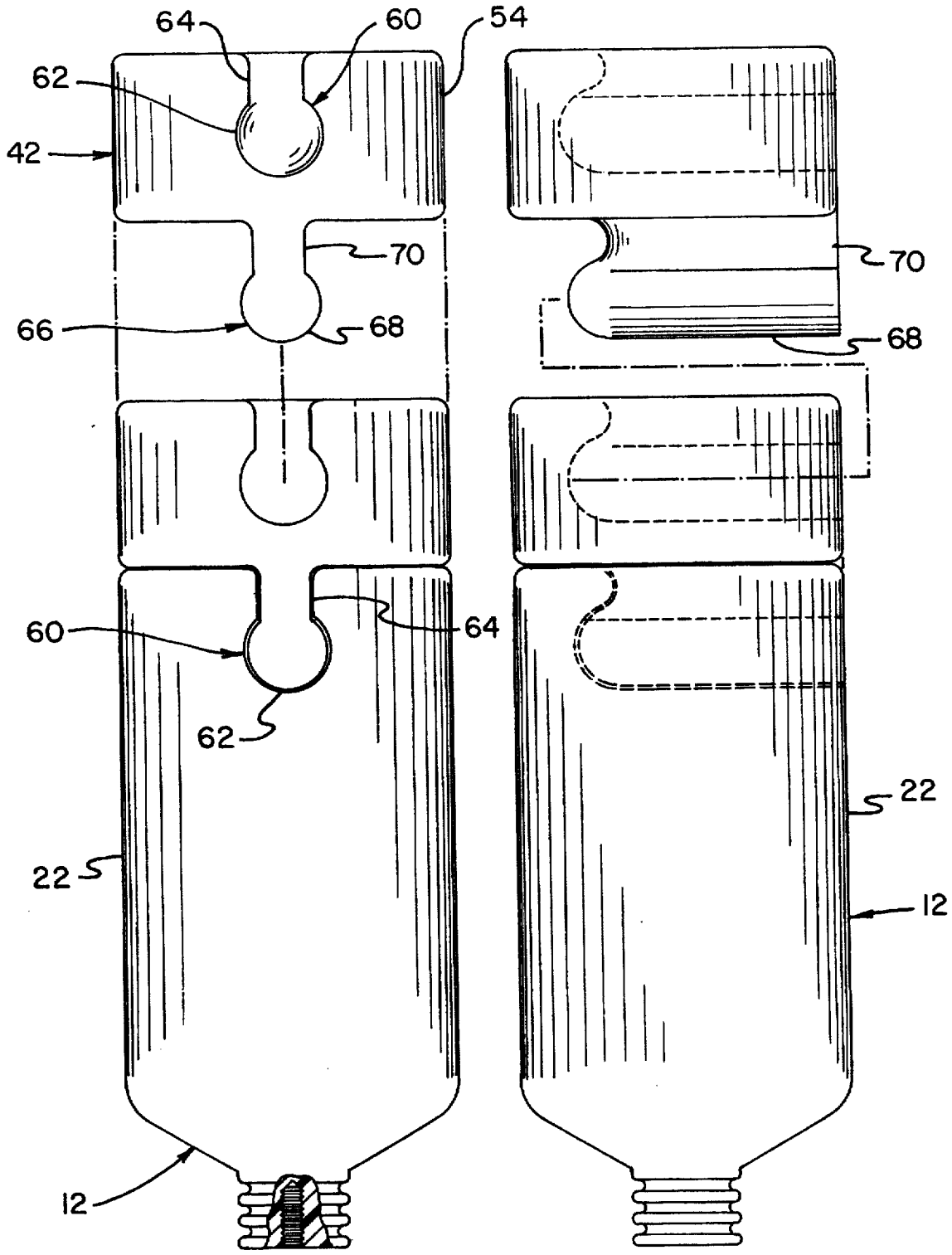
FIG. 6 is a plan view of an alternate construction of hollow container 22.
FIG. 7 is a side view of FIG. 6.

Referring now to FIGS. 6 and 7, it can be shown that the cylindrical side wall 24 of the hollow container 22 may alternatively be provided with a transverse slot 60 extending across the closed upper end 30 of the hollow container 22. The transverse slot 60 advantageously comprises a closed cylindrical bore 62 extending into the hollow container 22 through the sidewall 24 thereof. The cylindrical bore 62 is sealed from communication with an interior of the hollow container by unlabeled sidewall structure which circumscribes the cylindrical bore and integrally continues into a rectangular bore 64 extending between the cylindrical bore 62 and the closed upper end 30 of the hollow container 22. Thus, the sealed integrity of the hollow container 22 is not violated through such construction of the transverse slot extending thereinto. In this configuration, the hollow extension caps 42 each include hollow chamber 54 with a transverse projection 66 which can be laterally positioned into the transverse slot 60 of the hollow container 22. The transverse projection 66 comprises a cylindrical projection 68 coupled to a lower surface of the hollow chamber 54 by a rectangular projection 70. Thus, the cylindrical projection 68 is correspondingly shaped relative to the cylindrical bore 62, with the rectangular projection 70 being correspondingly shaped relative to the rectangular bore 64. To permit a stacking coupling of a plurality of such extension caps 42, the extension caps additionally include a transverse slot 60 similarly comprising a closed cylindrical bore 62 extending into the hollow chamber 54 which integrally continues into a rectangular bore 64 extending between the cylindrical bore 62 and a closed upper end of the hollow chamber 54. By this structure, one or more hollow extension caps 42 can be secured to the closed upper end 30 of the hollow container 22 so as to project above the waterline 20 within the pool skimmer 18.

In use, the skimmer ice protector 10 may be inserted into the pool skimmer 18, as shown in FIG. 1, whereby the plug means 14 engages the fluid conduit 16 to seal the fluid conduit and support the expansion compensator means 12 in substantially vertical orientation shown. The fluid conduit 16 may then be drained or filled with an antifreeze solution or the like, whereby water contained within the pool skimmer 18 will compress the hollow container 22 during freezing thereof to preclude damage to the pool skimmer 18.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A universal skimmer ice protector comprising:

an expansion compensator means for projecting above a waterline of a pool skimmer such that freezing of water within said skimmer will compress said expansion compensator means to preclude expansion and fracturing of said pool skimmer during freezing conditions;

a plug means secured to said expansion compensator means for engaging and sealing a fluid conduit of said pool skimmer and supporting said expansion compensator means in a substantially vertical orientation; and, an extension cap means attachable to said container for increasing a height of said container.

2. A universal skimmer ice protector comprising:

an expansion compensator means for projecting above a waterline of a pool skimmer such that freezing of water within said skimmer will compress said expansion compensator means to preclude expansion and fracturing of said pool skimmer during freezing conditions, said expansion compensator means comprising a hollow container having a compressible cylindrical side wall extending in a first direction to define a tapered neck terminating in a mounting boss of sealed, solid construction, said compressible cylindrical side wall extending in a second direction and terminating in a closed upper end, said cylindrical side wall of said hollow container including a circumferential mounting groove which extends about said cylindrical side wall, and a pair orthogonally oriented transverse mounting grooves extending from diametrically opposed sides of said circumferential mounting groove and over said closed upper end thereof;

a plug means secured to said expansion compensator means for engaging and sealing a fluid conduit of said pool skimmer and supporting said expansion compensator means in a substantially vertical orientation, said plug means comprising a first washer having a center aperture positioned in abutting relation relative to said mounting boss; a resilient stopper having a center aperture positioned against said first washer; a second washer positioned against an outer distal end of said resilient stopper, said second washer having a plurality of engaging prongs which project into said stopper; and a fastener fixedly secured to said second washer and extending through said center apertures in said resilient stopper and said first washer to threadably engage said mounting boss and secure said plug means to said hollow container, wherein said stopper can be frictionally engaged to a fluid conduit and said hollow container can be rotated to advance said fastener into said mounting boss to effect longitudinal compression and radial expansion of said stopper to frictionally lock said stopper relative to said fluid conduit, said resilient stopper being tapered, said first washer being positioned against a first end of the resilient stopper, with said first end of said resilient stopper having a first diameter and tapering to a second end having a second diameter, wherein said first diameter of said resilient stopper is substantially greater than said second diameter at said second end thereof, said second washer being positioned against said second end of said resilient stopper, wherein said first washer is of a third diameter and said second washer is of a fourth diameter, with said third diameter being substantially larger than said fourth diameter; and, an extension cap means attachable to said container for increasing a height of said container, and further wherein said extension cap means comprises a plurality of hollow extension caps which can be selectively engaged to said closed upper end of said hollow container, said extension caps each including a receiver positionable over said closed upper end of said hollow container; a circumferential projection extending about an interior surface of said receiver and correspondingly positioned so as to project into said circumferential mounting groove of said cylindrical side wall; orthogonally oriented transverse projections extending from said circumferential projection across an interior surface of said receiver and correspondingly positioned so as to engage said transverse mounting grooves of said cylindrical side wall; and a compressible chamber attached to said receiver, said chamber having a circumferential mounting groove permits the attachment of another hollow extension caps thereto.

* * * * *